United States Patent [19]

Illman et al.

[11] 4,253,840

[45] Mar. 3, 1981

[54] HOT-MELT SIZE COMPOSITIONS AND PROCESS FOR TEXTILES

[75] Inventors: Walter F. Illman, Greensboro; Delano M. Conklin, Burlington; Clifton H. Karnes, Jr., Greensboro; Robert C. Malpass, High Point, all of S.C.

[73] Assignee: Burlington Industries, Inc., Greensboro, N.C.

[21] Appl. No.: 22,176

[22] Filed: Mar. 20, 1979

[51] Int. Cl.[3] ..... D06M 15/16; D06L 1/06

[52] U.S. Cl. ..... 8/115.6; 8/138; 8/139; 8/141

[58] Field of Search ..... 8/138, 115.6, 139, 141

[56] References Cited

U.S. PATENT DOCUMENTS

| | | | |
|---|---|---|---|
| Re. 29,287 | 7/1977 | Illman et al. | 28/178 |
| 2,877,196 | 3/1959 | Reding | 260/28.5 |
| 3,025,167 | 3/1962 | Butler | 99/171 |
| 3,048,553 | 8/1962 | Moss | 260/28.5 |
| 3,466,717 | 9/1969 | Kuroda | 28/28 |
| 3,476,504 | 11/1969 | Case | 8/138 |
| 3,625,735 | 12/1971 | Fernstrom et al. | 8/115.6 |
| 3,645,948 | 2/1972 | Stahl | 260/28.5 |
| 3,739,567 | 6/1973 | Williamson | 57/153 |
| 3,841,833 | 10/1974 | Minkema et al. | 8/138 |
| 3,960,485 | 6/1976 | Fantl et al. | 8/138 |
| 3,984,594 | 10/1976 | Sano et al. | 427/392 |
| 4,076,629 | 2/1978 | Beaumont et al. | 252/8.6 |
| 4,106,900 | 8/1978 | Perkins | 8/115.6 |

FOREIGN PATENT DOCUMENTS

| | | | |
|---|---|---|---|
| 40-14280 | 7/1965 | Japan | 8/138 |

*Primary Examiner*—John Kight, III

*Attorney, Agent, or Firm*—Cushman, Darby & Cushman

[57] ABSTRACT

A hot-melt warp yarn size composition and a method for applying, desizing, and disposing of it which essentially eliminates atmospheric and water pollution at all stages of the process. The size is a melt blend of ethylene/vinyl acetate copolymer with microcrystalline, paraffin, or hydrogenated tallow wax. It is applied as a melt to warp yarn, desized with hot petroleum solvent, and the extracted size and unrecovered solvent burned to non-polluting carbon dioxide and water.

8 Claims, 3 Drawing Figures

HOT-MELT SIZE COMPOSITIONS AND PROCESS FOR TEXTILES

BACKGROUND AND SUMMARY OF THE INVENTION

1. Field of the Invention

This invention relates to the hot melt sizing of textile warp yarns, more specifically to a novel class of non-aqueous warp sizes and to a method of applying, removing, and disposing of them to eliminate the pollution problems commonly associated with conventional aqueous sizing methods.

2. Description of the Prior Art

The primary purpose of any textile warp size is of course to enhance the capacity for weaving or knitting of the yarn to which it is applied. Today's high-speed looms and knitting machines demand lubricity, flexibility, adherence to yarn, toughness, and other size characteristics for surpassing those of earlier machines. Faster moving loom parts which contact the yarns, such as shuttles and filling yarn projectiles, as well as the faster moving filling yarns which they carry through the warp yarns, or shed, likewise impose increasingly stricter requirements upon warp sizes.

Sizing of textile warp yarns, commonly called slashing, is thus an essential step in the preparation of yarns for weaving. Size is removed after weaving is complete. For many years the technology of warp sizing was dominated by the application of aqueous starch suspensions on massive machines known as slashers, the entire process being characterized from the beginning by high capital costs and large space requirements and more recently, in addition, by steadily rising energy costs and burgeoning water pollution problems. The advent of the more generally effective polyvinyl alcohol warp sizes did little to solve the application and removal problems associated with starch. These more modern aqueous sizes still utilized the slasher, they still required large outlays of energy to dry water from the yarn after slashing, and they merely substituted one kind of water pollution problem for another when the time came to remove the size after weaving. That is, the high B.O.D. (biological oxygen demand) of starch in waste desizing water was replaced as a pollution problem by the non-biodegradability of polyvinyl alcohol in the waste water, and hence a high C.O.D. (chemical oxygen demand). Elaborate systems have been devised to remove this polyvinyl alcohol, or in some instances to recover it for reuse, but these systems are expensive to install and operate. Also, the polymer they recover may be less pure than required for dependable reuse.

Despite its established position in the textile industry as the standard machine for application of size to warp yarns in preparation for weaving, the slasher has long been recognized to be a ponderous machine long overdue for replacement by something better. Particularly in today's atmosphere of urgent concern over conservation of energy and control of stream pollution, the slasher and the water-based sizes applied to yarns on it throughout the textile industry are coming under increasing scrutiny.

A number of systems have been proposed for solving the problems associated with applying aqueous warp sizes to yarns on the slasher. For example, U.S. Pat. No. 3,984,594, Sano et al, describes a process for sizing a cellulosic-fiber containing yarn with a non-aqueous solution of an acrylic or methacrylic copolymer in a halogenated hydrocarbon. The size is removed from the fabric after weaving by dissolution in the same or a different halogenated hydrocarbon solvent. This art process is thus complicated by the need to provide against air pollution by the toxic halogenated hydrocarbon. Enclosed drying facilities to remove solvent from the yarn prior to weaving are also required. Although typically urged as less expensive, particularly in energy terms, than drying of aqueous-sized yarns, drying of halogenated solvent from the sized yarn nevertheless remains as a significant equipment and process need and expense.

It is especially in the economic aspects of a sizing-desizing system based on expensive halogenated hydrocarbon solvents that the shortcomings of such a system become most prominent. The entire system is economically dependent upon keeping solvent losses and solvent makeup to an absolute minimum. This means not only that evaporative losses of solvent during the sizing and drying operations must be rigidly controlled, but that subsequent halogenated hydrocarbon desizing of fabric after weaving faces similar economic problems. A slasher type sizing machine is still employed.

For some years it has been recognized that a system for melt sizing of warp yarns would offer many advantages. At the sizing symposium of Sept. 9–12, 1974 in Budapest, Hungary (Melliand Textilberichte, English Edition, April, 1975, p. 262), it was observed, with respect to sizing machines and sizes: "All problems related with drying (energy costs, error sources) can be avoided, if sizing agents can be used which rigidify at room temperature. At present there is no satisfactory and practical solution; but it is probable that melt sizes will be important in the future."

U.S. Pat. No. 3,446,717, Kuroda, describes a method and apparatus for sizing warp yarns, wherein size is applied within a sizing chamber provided with a vat containing a quick solidifying molten size whose predominant composition is wax. Exemplified for application in the Kuroda apparatus is a molten size made with hardened castor oil, 2-ethylhexyl acrylate, and benzoyl peroxide, one of a number of sizes described in Japanese Patent Publication No. 14280/1965. More broadly, the latter publication describes certain classes of polymers or copolymers soluble in specified types of wax, capable of application to yarns by melt means. Desizing is not discussed.

U.S. Pat. No. Re. 29,287 describes another type of apparatus for applying molten size to yarn. This patent is particularly concerned with the demanding process of applying a melt size which can be removed by aqueous solvents. At present, however, the availability of such sizes is limited, and their costs high.

Another solution to the pollution problems associated with sizing of textile warp yarns which has been proposed in the art is to recover the size for reuse. Recovery for reuse is particularly attractive, at least in theory, because it offers greater opportunity for practical use of the more expensive types of sizes. Unfortunately, theory and fact usually part company in actual practice, either because recovery is not complete enough to be economically feasible, or because the recovered size carries down impurities with it which build up too much during repeated cycles of sizing and desizing.

SUMMARY OF THE INVENTION

According to the present invention, it is possible to avoid most of the disadvantages associated with the prior art systems and procedures. The application of size according to the present invention results in a yarn that performs well during weaving, knitting, or like fabric forming steps. Both the size and the desizing solvent utilized are of such a nature, and inexpensive enough, that unrecovered solvent and size can be burned to recover their fuel value, with expensive size recovery systems being avoided. The size is applied utilizing grooved rollers or other simple apparatus, and the use of a slasher is avoided.

The process for treating textiles according to the present invention comprises the steps of establishing a continuous feed of warp yarn, continuously applying a melt blend warp size to the continuously fed yarn, forming the sized yarn into fabric, desizing the fabric utilizing a heated hydrocarbon solvent, and removing the solvent from the fabric, including partially recovering the solvent. The melt blend warp size consists essentially of synthetic organic polymer or copolymer and wax, the wax selected from the group consisting essentially of microcrystalline, paraffin, and hydrogenated tallow waxes. More preferably, 2–22%, based upon yarn weight, of melted size is applied, which size comprises 10–45% of 85–70% ethylene to 15–30% vinyl acetate copolymer having an inherent viscosity of 0.5–1.02; and 90–55% wax.

The solvent preferably is a hot petroleum solvent, and both the size and solvent are burnable to carbon dioxide and water. The process comprises the further step of burning a mixture of the size removed from the fabric and unrecovered solvent while recovering the heat value during burning.

Desizing preferably is accomplished by soaking the fabric in a hot petroleum solvent and then scouring the fabric in solvent vapours with hot liquid solvent, followed by partially distilling the scouring extract to recover solvent and a mixture of unrecovered solvent and size. The removal of solvent from the fabric is preferably accomplished by drying the fabric to form vapours, collecting the vapours, condensing the collected vapours, and distilling the condensed vapours to form recovered solvent.

According to the present invention a textile yarn is produced melt sized with 2–20%, based upon yarn weight, of size. The size comprises 10–45% of 85–70% ethylene to 15–30% vinly acetate copolymer having an inherent viscosity of 0.5–1.02; and 90–55% wax, the wax selected from the group consisting essentially of microcrystalline, paraffin, and hydrogenated tallow waxes.

It is the primary object of the present invention to provide an advantageous process for the sizing and desizing of textiles with non-aqueous warp sizes, and to produce advantageous melt-sized textile yarns. This and other objects of the invention will become apparent from an inspection of the detailed description of the invention and from the appended claims.

DETAILED DESCRIPTION OF THE INVENTION

Figure 2:
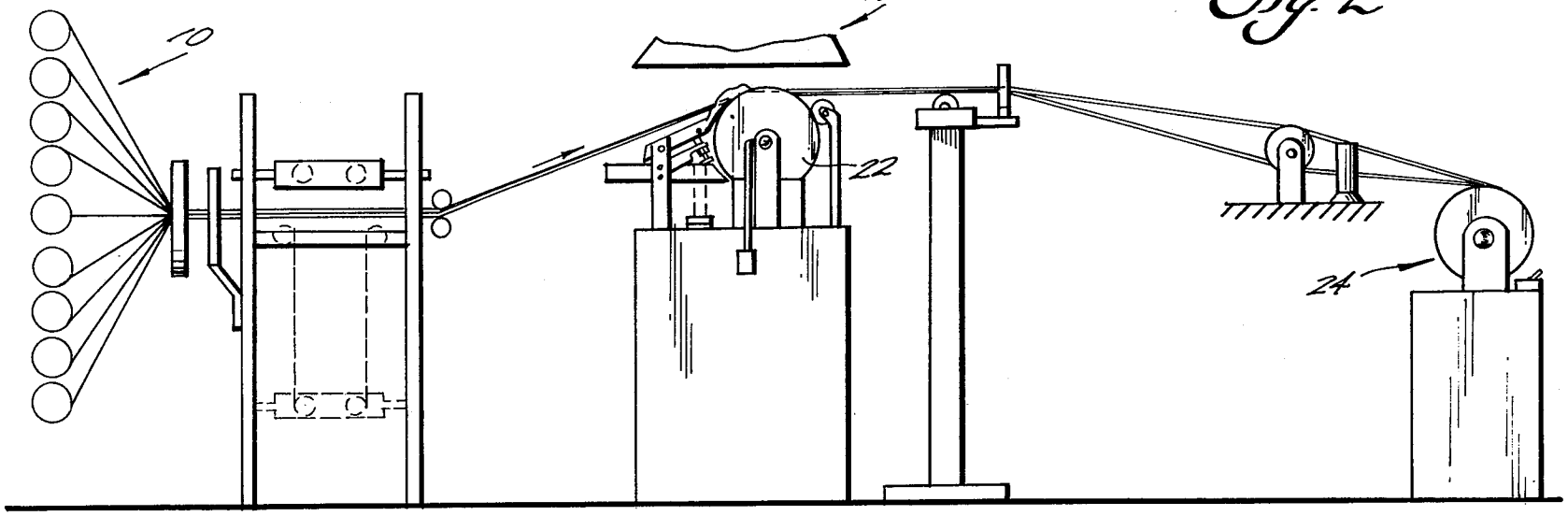
FIG. 2 is a side schematic view of exemplary sizing apparatus utilizable in practicing the present invention.

The present invention process depends upon the fact that certain polymeric compositions, when melted with microcrystalline, paraffin, or hydrogenated tallow waxes, yield the desirable lubricity, flexibility, yarn adherence and toughness characteristics required of today's warp sizes. The size composition is applied to yarns by means of an efficient hot-melt system, and after the yarn is woven or knitted into fabric the size is removed by extraction with a hot petroleum solvent, the resulting solution then being partially concentrated to recover solvent for reuse, leaving as a residue the used size together with enough solvent to make the combination fluid enough for easy pumping to burners, there being efficiently burned to recover the fuel values therein. The size and solvent combinations are chosen to be substantially burnable to non-polluting carbon dioxide and water.

To be economically feasible, the sizes of the invention must not only be efficient sizing agents and burnable without pollution, but they must be inexpensive enough to tolerate being used only once, taking account of the absence of conventional recovery cost or need for downstream pollution control, plus the positive thermal value of the residue as a boiler fuel or other source of utilizable process heat.

The preferred sizes of the invention which fulfill these requirements are a class of ethylene/vinyl acetate copolymers melt-blended with microcrystalline, paraffin, or hydrogenated tallow wax. Other polymers or copolymers suitable for combination with the named waxes in the invention are those of the styrene/maleic ester, acrylic ester, vinyl ether, and other vinyl ester copolymers having the required melt sizing characteristics in conjunction with solubility in hot petroleum solvent, all of these compositions being burnable to carbon dioxide and water.

More particularly, compositions comprising 10 to 45 percent of a synthetic organic polymer or copolymer, having an inherent viscosity of about 0.50 to 1.02, melted with 90 to 55 percent of microcrystalline, paraffin, or hydrogenated tallow wax, are effective sizes for use in the process of the invention.

The most preferred sizes of the invention are ethylene/vinyl acetate copolymers comprising 85 to 70 percent ethylene and 15 to 30 percent vinyl acetate and having an inherent viscosity of 0.50 to 1.02, melt-blended with microcrystalline, paraffin, or hydrogenated tallow wax in proportions of 45 to 10 percent copolymer and 55 to 90 percent wax. Particularly advantageous is a melt blend of copolymer comprising about 82 percent ethylene and 18 percent vinyl acetate, combined with a paraffin wax of high melting point and hardness in proportions of about 35 percent copolymer to 65 percent wax. Depending upon the nature of the yarn being sized, from 2 to 22 percent of the size is applied, based on the weight of the yarn, the smaller amounts being needed for filament yarns, the larger amounts for spun yarns, especially if they are very hairy. The invention is applicable to both of these structural types of yarn, comprised of various chemical types of natural and synthetic fibers such as cotton, wool, silk, nylon, polyester, acrylic, rayon, polyolefin, glass, and others, as well as blends of these.

Warp yarns in the present invention are inclusive of both filament and spun yarns. And although of greatest value for preparing yarns for weaving, on both conventional looms and the newer high-speed Sulzer, water-jet, and air-jet looms, the yarns of the invention are also intended for use in knitting, especially warp knitting.

The preferred ethylene/vinyl acetate copolymers are well known in the art, especially as resins for blending in hot-melt coatings and adhesives. Their textile application as hot-melt adhesives in bonding nonwoven structures and as adhesive backings in tufted and pile carpets has been proposed (see U.S. Pat. No. 3,739,567); however, no prior use of them in warp sizes is known, and indeed, their use in adhesives would tend to suggest their having properties, such as tackiness, generally inimical to application within the bounds of the demanding requirements of the warp sizing operation. It is thus very surprising that the ethylene/vinyl acetate copolymers have been found unusually effective in warp-size blends, even with particularly difficult to size hairy yarns made from polyester/wool blends and used in making tightly woven fabrics. Tight, high-speed weaving of such hairy yarns requires most uncommon performance characteristics in a warp size.

Several manufacturers produce these copolymers. The Plastic Products and Resins Department of the DuPont Company produces a large number of composition and viscosity combinations under their general trademark "Elvax®." The Elvax resins are sold in "grade" groupings based on vinyl acetate content: for example, 200-series resins contain about 28 percent vinyl acetate; 300-series, 25 percent; and 400-series, 18 percent. Within each series the inherent viscosity rises with increasing grade number, from 0.54 with Elvax 210, to 0.94 with Elvax 260, and 1.01 with Elvax 265. Among these resins Elvax 260 has proved particularly effective in sizes of the present invention where higher viscosity was desirable, as for sizing hairy yarns, while the lower viscosity of Elvax 410 was better when greater yarn penetration was needed. All grades of Elvax are stabilized against viscosity variation in use by addition of 50–1000 ppm of butylated hydroxytoluene.

The term "microcrystalline wax" applies to a wide variety of petroleum wax fractions, the compositions of which vary considerably, depending upon both the source of the original petroleum (Pennsylvania, mid-coneinent, Mid-East, etc.) and the type and degree of refinement which the fractions have undergone. It is believed that any reasonably refined microcrystalline wax as sold in the trade will perform in the practice of the present invention. As a general rule of thumb, taking account that microcrystalline waxes are extremely hard to rid of last traces of oil in the refining process, the less oil the wax retains, the better its performance in the process of the invention. An oil content of not more than 0.1–0.3 percent seems optimum in the practice of the present invention.

Paraffin wax is another petroleum wax which defies precise definition. It sells in various grades as generally recognized in the trade. "Refined paraffin wax", melting point (ASTM Test D 87-57) 122°–24° F., when formulated with an "Elvax" copolymer, is suitable for the practice of the invention. More preferred is a "fully refined paraffin wax", which term in the trade denotes a solvent-refined paraffin wax having a melting point in the range of about 150°–65° F. or even higher. When melt-blended with Elvax 410 at the level of 65 percent wax to 35 percent copolymer, Parvan 3505 makes a particularly satisfactory melt size, which composition is preferred for sizing a variety of yarns. Parvan 3505 is a fully refined paraffin wax made by Exxon Company and having a congealing point of 164° F. (ASTM D838).

Hydrogenated tallow is a fully hydrogenated animal tallow, typically from beef, catalytically hydrogenated to remove essentially all unsaturation. This material can be used according to the present invention both as a melt-size component and as an overwax in some instances.

The inherent viscosity of the ethylene/vinyl acetate copolymers as noted herein is calculated from the equation, $$\text{Inherent viscosity} = (1/c) \ln (\eta/\eta_o)$$

Where $\rho$ is the viscosity at 30° C. of a 0.25% solution of the copolymer in toluene, $\eta_o$ is the viscosity of the solvent, and c is the concentration.

The melt size compositions utilized in the process of the invention may if desired contain small amounts of other ingredients besides polymer and wax, for example, penetrants to increase penetration of size into yarn during sizing or to aid solvent desizing, antioxidant, lubricants, antistatic agents, polymeric modifiers such as polyolefins to harden or toughen the basic formulation, and the like.

Under certain circumstances, as in the case of size formulations based on microcrystalline wax where the sized yarn is to be woven on a high speed Sulzer loom, a special problem specifically related to this type of loom has been encountered and resolved. The mechanism of the Sulzer loom is lubricated by means of a mist lubricant, traces of which mist at the loom and in the surrounding atmosphere have been found to be particularly absorbed by the microcrystalline wax-based melt size, adversely affecting the weaving performance of some yarns sized therewith. In these instances a light overwaxing with hydrogenated tallow by conventional means can be effective in significantly improving the Sulzer loom performance. Yarns to which the overwax are applied may also be woven on other types of looms, so that special inventories of yarn for Sulzer weaving need not be maintained.

Desizing is accomplished utilizing a hydrocarbon solvent, preferably a hot petroleum solvent. The term "hot petroleum solvent," as used herein refers to petroleum spirits, mineral spirits, Varsol, Stoddard solvent, refined kerosene, and the like petroleum fractions, used at temperatures up to their boiling points. All of these solvents are readily commercially available.

Figure 1:
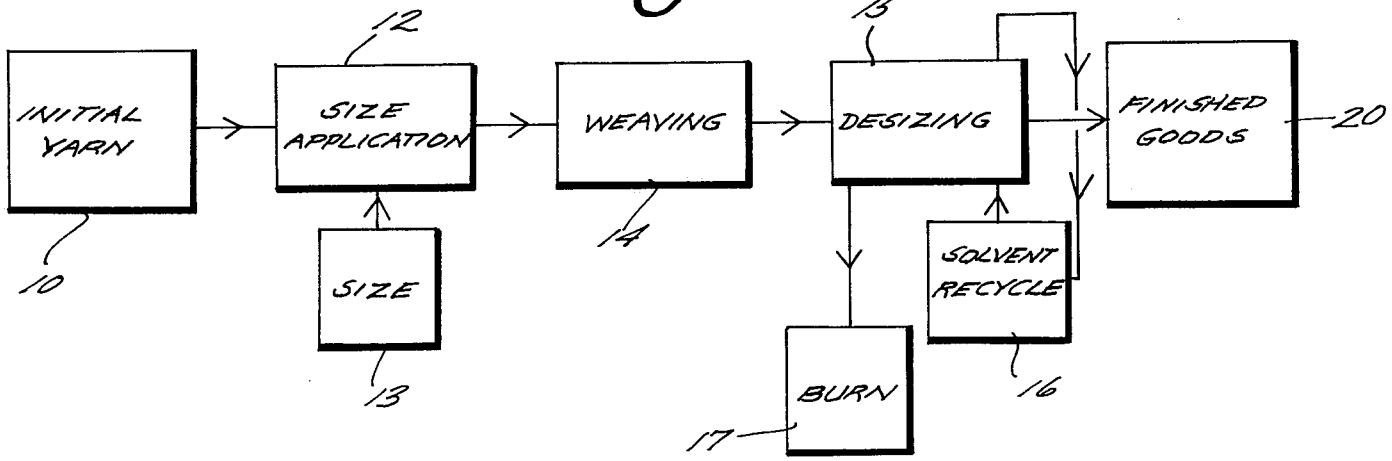
FIG. 1 is a box diagram of an exemplary process according to the present invention.

An exemplary process according to the present invention is illustrated schematically in FIG. 1. Warp yarn, from an initial supply 10, is established in a continuous feed to a size applicator 12 whereat size from a source 13 is applied to the yarn. The yarn subsequently is used to form cloth as by weaving or knitting at station 14. The fabric so formed is desized at station 15, solvent for desizing being applied and recycled by mechanism 16, and unrecovered solvent and removed size being burned at station 17. The desized fabric with solvent removed then is taken up to comprise the finsihed goods, 20.

Figure 3:
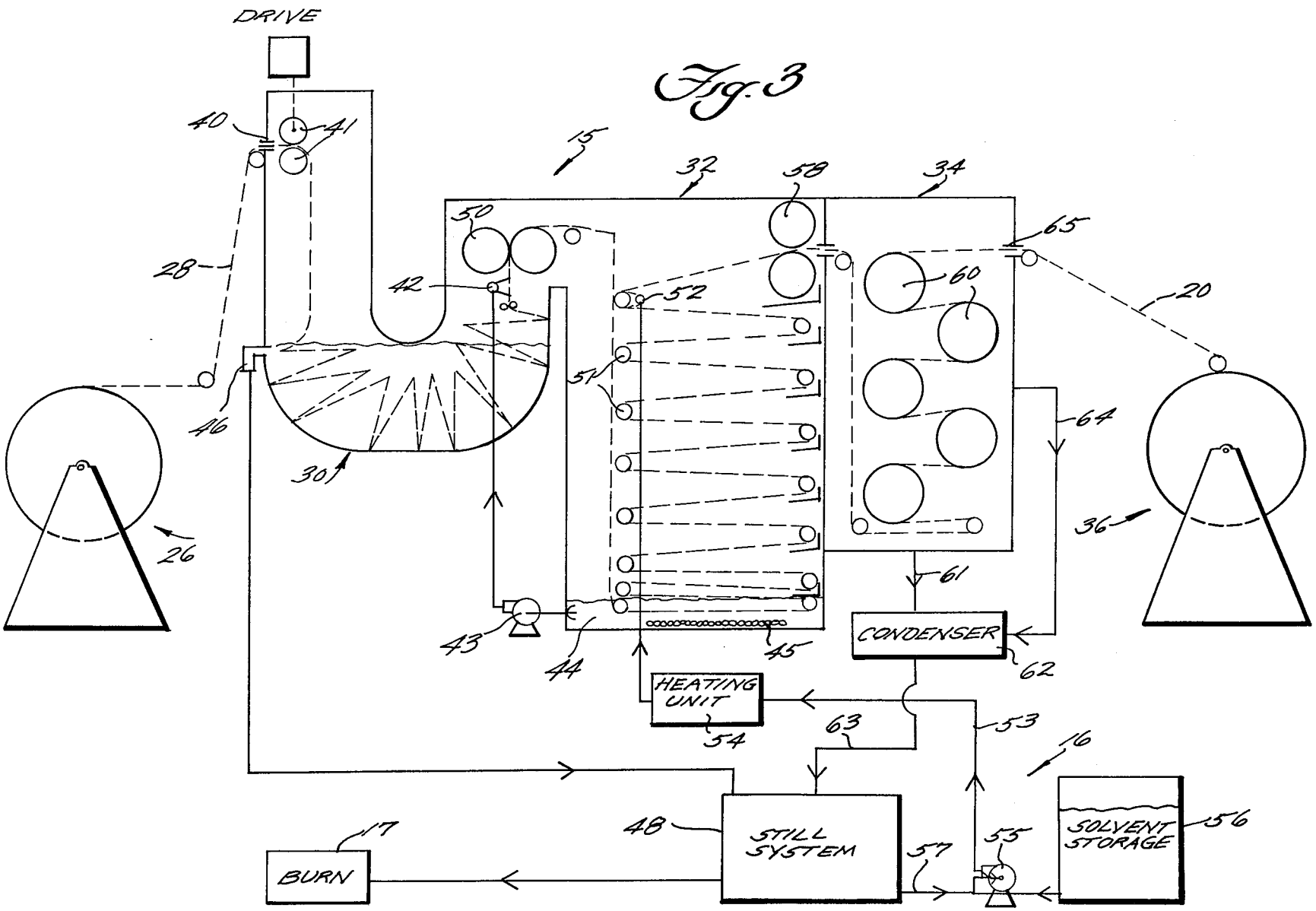
FIG. 3 is a schematic view of exemplary desizing and solvent removal apparatus that may be utilized in practicing the invention.

Typical apparatus for effecting size application is illustrated schematically in FIG. 2, and corresponds to the apparatus illustrated in U.S. Pat. No. Re. 29,287, the disclosure of which is hereby incorporated by reference herein. The primary feature of such sizing apparatus is a grooved roller 22 over which the yarn is fed to effect sizing, the yarn being taken up by collection mechanism 24 to be subsequently utilized for weaving or knitting. If desired, the preferred size according to the present invention may be prepared in preformed blocks which are pressed up to the grooves of the heated roller 22. Alternatively, the size components may be melted in a separate container and poured or pumped into a melt pool tank from which the size may be applied to the grooved roller which turns through the top surface of the pool. Alternatively, size application can be effected utilizing conventional kiss rolls, pads, brushes, and/or doctor blades, several such conventional systems being illustrated in U.S. Pat. No. 3,466,717. Exemplary apparatus 15 for desizing the fabric utilizing a heated hydrocarbon solvent, and removing the solvent from the fabric, including apparatus 16 for partially recovering the solvent, is illustrated schematically in FIG. 3. The apparatus includes a let-off unit 26 from which the sized fabric 28 is removed, a J-box or like structure for soaking the fabric 28, a scouring structure 32, a drying unit 34, and a take up unit 36 for taking up the final fabric 20.

The fabric 28 is passed through lip seal 40 into the top of the J-box 30, drive rolls 41 pulling the fabric 28 into the structure 30. Hot petroleum solvent is sprayed by nozzle head 42 onto the fabric, the solvent being withdrawn by pump 43 from the bottom of the scouring structure 44 which includes heating coils 45 therein for maintaining the solvent temperature at the desired level. A level of liquid solvent is maintained in the J-box 30 by the positioning of the withdrawal conduit 46, and the fabric 28 is folded—as indicated—while it passes through the J-box 30. Withdrawn liquid from the J-box 30 is fed to conventional distillation apparatus 48.

At the top of the J-box 30 the fabric passes between extraction rolls 50 into the scouring structure 32, being passed in a tortuous path up through the structure 32 around the rollers 51 while being exposed in hot petroleum solvent vapours to a countercurrent flow of liquid solvent which is introduced into structure 32 at spray nozzle 52, having passed through line 53 and through the heating unit 54 to nozzle 52, under the force of the pump 55. The pump 55 withdraws solvent from the clean solvent storage tank 56 and from the clean solvent return line 57 from the distillation structure 48. The solvent unrecovered in the distillation structure 48, mixed with size and any other solvent-soluble yarn additives which may be present, is passed to a conventional boiler 17 or the like for burning while recovering the heat value from the mixture.

The desized fabric passes between extraction rolls 58 into the drying structure 34, being dried by conventional techniques as by passage around drying cans 60. The vapours driven off during drying are collected and fed via lines 61 and 64 to a conventional condenser 62. The condensed liquid passes via line 63 to the distillation structure 48. Finally, the now final fabric 20 passes through lip seal 65 to the take up structure 36.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent processes and products.

What is claimed is:

1. A process for treating textiles comprising the steps of: establishing a continuous feed of warp yarn; continuously applying a warp size to the continuously fed warp yarn to form sized yarn; forming the sized yarn into fabric; desizing the fabric utilizing a solvent; and removing the solvent from the fabric; wherein the improvement comprises:

applying as the warp size a melt warp size consisting essentially of synthetic organic polymer or copolymer and wax, the wax selected from the group consisting essentially of microcrystalline, paraffin, and hydrogenated tallow waxes; and wherein the desizing is accomplished utilizing a heated hydrocarbon solvent, and wherein the removed solvent is recovered.

2. A process as recited in claim 1 wherein the size is burnable to carbon dioxide and water, and the solvent is a hot petroleum solvent, and comprising the further step of burning a mixture of the size removed from the fabric and unrecovered solvent while recovering the heat value during burning.

3. A process as recited in claims 1 or 2 wherein said size applying step is practiced by applying 2–22%, based upon yarn weight, of melted size having 10–45% synthetic organic polymer or copolymer with an inherent viscosity of 0.5 to 1.02, and 90 to 55 percent wax.

4. A process as recited in claim 1 wherein the desizing step is accomplished by soaking the fabric in a hot petroleum solvent, scouring the fabric in solvent vapors with hot liquid solvent, and then partially distilling the scouring extract to recover solvent in a mixture of unrecovered solvent and size.

5. A process as recited in claim 4 wherein the mixture of unrecovered solvent and size is burned while recovering the heat value during burning.

6. A process as recited in claim 1 wherein the solvent removal step is accomplished by drying the fabric to form vapors, collecting the vapors, condensing the collected vapors, and distilling the condensed vapors to form recovered solvent.

7. A process as recited in claims 1, 2, 4, or 6 wherein said size applying step is accomplished by applying 2–22%, based upon yarn weight, of melted size which comprises 10–45% of 85–70% ethylene to 15–30% vinyl acetate copolymer having an inherent viscosity of 0.5 to 1.02, and 90 to 55 percent wax.

8. A textile yarn melt-sized with 2–22%, based upon yarn weight, of a size which comprises 10–45% of 85–70% ethylene to 15–30% vinyl acetate copolymer having an inherent viscosity of 0.5–1.02; and 90–55% wax, the wax selected from the group consisting essentially of microcrystalline, paraffin, and hydrogenated tallow waxes.

* * * * *